US005727747A

United States Patent [19]

Hannen et al.

[11] Patent Number: 5,727,747

[45] Date of Patent: Mar. 17, 1998

[54] METHOD AND DEVICE FOR REMOVING A FOIL WRAPPING DRAWN OVER A STACK OF GOODS

[75] Inventors: Reiner Hannen, Goch-Pfalzdorf; Norbert Vermeulen, Kleve; Frank Michels, Kleve-Materborn, all of Germany

[73] Assignee: MSK-Verpackungs-Systeme GmbH, Kleve, Germany

[21] Appl. No.: 619,658

[22] PCT Filed: Sep. 23, 1994

[86] PCT No.: PCT/EP94/03185

§ 371 Date: Mar. 18, 1996

§ 102(e) Date: Mar. 18, 1996

[87] PCT Pub. No.: WO95/08479

PCT Pub. Date: Mar. 30, 1995

[30] Foreign Application Priority Data

Sep. 23, 1993 [DE] Germany ..... 9314339 U
Jan. 12, 1994 [DE] Germany ..... 44 00 661.6

[51] Int. Cl.[6] ..... B65H 18/10; B65B 69/00

[52] U.S. Cl. ..... 242/527; 242/532.5; 242/533.8; 242/538; 242/526.3; 53/381.2; 53/492

[58] Field of Search ..... 242/527, 527.2, 242/527.3, 532.5, 532.6, 532.7, 533.8, 538, 539, 526.3; 53/492, 381.2

[56] References Cited

U.S. PATENT DOCUMENTS

| | | | |
|---|---|---|---|
| 1,022,024 | 4/1912 | Girard | 242/533.8 |
| 1,853,384 | 4/1932 | Snow | 242/532.5 |
| 3,764,085 | 10/1973 | Hawkins | 242/526.3 |
| 4,550,881 | 11/1985 | Boardman | 242/527 |
| 4,635,869 | 1/1987 | Woodley | 242/532.7 |
| 5,125,630 | 6/1992 | Hoyt et al. | 242/526.3 |
| 5,197,687 | 3/1993 | Yamada et al. | 242/532.5 |
| 5,282,346 | 2/1994 | Masuda et al. | 53/118 |

OTHER PUBLICATIONS

Patent Abstracts of Japan, vol. 1, No. 2 (M-3) 51115190, Sep. 1976.

*Primary Examiner*—John M. Jillions
*Attorney, Agent, or Firm*—Herbert Dubno; Yuri Kateshov

[57] ABSTRACT

A process is disclosed for removing a shrink wrapping drawn over a stack of goods. The shrink wrapping is vertically cut at one side of the stack of goods, one edge of the cut is held and secured to a winding spindle, and the winding spindle is then guided around the stack of goods so that the shrink wrapping is winded on the winding spindle that rotates around its longitudinal axis. Also disclosed is a device for carrying out the process.

17 Claims, 6 Drawing Sheets

METHOD AND DEVICE FOR REMOVING A FOIL WRAPPING DRAWN OVER A STACK OF GOODS

CROSS REFERENCE TO RELATED APPLICATIONS

This application is a national phase of PCT/EP94/03185 filed 23 Sep. 1994 and based, in turn, upon German National Application P 44 00 661.6 of 12 Jan. 1994 and G 93 14 339.7 of 23 Sep. 1993 under the International Convention.

FIELD OF THE INVENTION

The invention relates to a method of removing a foil wrapping drawn over a stack of goods. The invention also relates to a device for carrying out the method.

1. Background of the Invention

In practice, stacks of goods, especially palletted goods, are secured with shrink foil or stretch foil, transported and delivered to the user. The user has to remove the foil in order to unpack the stack of goods. Usually this has been is done by hand.

2. Object of the Invention

It is the object of the invention to mechanize the removal of the foil.

SUMMARY OF THE INVENTION

This object is achieved with a method for the removal of a wrapping drawn over a stack of goods by vertically cutting the foil wrapping on one side of the stack of goods, by seizing one edge of the cut and fastening it to the winding spindle and guiding, the winding spindle around the stack of goods, thereby wrapping the foil around the winding spindle rotating about its longitudinal axis. In order to avoid damage to the stack of goods or to the goods stacked therein, the foil wrapping can be lifted off the stack of goods, area by area, and then cut open. The foil wrapped around the winding spindle is removed from the winding spindle and can then be disposed of, or first compacted and then disposed of.

It is suitable to guide the winding spindle around the stack of goods by keeping a constant distance therefrom, because then the forces acting on the foil remain basically constant and the tearing lines in the foil continue in the peripheral direction of the stack of goods. Particularly the winding spindle rotating about its longitudinal axis can pull itself around the stack of goods without additional actuation at the foil.

When the tearing of the foil is desired in a certain area, e.g. so that the upper part of the stack of goods still remains covered by a partial foil wrapping, the foil wrapping is heated below the upper part of the stack of goods. The same applies when the desired tearing line is in the area of a support (pallet) of the stack of goods, for which purpose the foil wrapping is heated in the area of the support (pallet) of the stack of goods.

The stack of goods can be lifted, in order to eliminate possible shrinkage of the foil wrapping at the bottom.

A device for carrying out the method is equipped with a frame, a supporting arm on the frame and which is pivotable about a vertical axis and can be driven around the axis, for a winding spindle suspended therefrom. Such devices are known for wrapping a stack of goods. In contrast thereto the device of the invention is characterized in that on the supporting arm a guide slide carriage movable in its longitudinal direction is arranged, that the winding spindle and a guide mast extending parallel thereto are suspended on the guide slide carriage, and that a vertically displaceable lifting slide carriage with a separating device is guided on the guide mast. In particular the lifting slide carriage can have a suction device connectable to a suction source, by means of which the foil can be lifted off the stack of goods, area by area. The separating device can be a blade movable along the lifting slide carriage by means of a drive, particularly a lifting cylinder, or a heating wire extending parallel to the winding spindle. Further on the guide mast hot air nozzles can be provided, which are directed so that they heat the portion of the foil in front of the winding spindle in the direction of rotation, thereby defining the mentioned tearing lines. For the transfer of the cutoff edge to the winding spindle, the winding spindle can be associated, at least in certain areas, with a gripping device, which seizes the free cutoff edge and clamps it to the winding spindle.

Underneath the frame it is possible to provide a hoisting device for the stack of goods, so that the bottom shrinkage can be removed when the stack of goods is lifted. Finally also holding-down means which can be lowered unto the upper side of the stack of goods could be provided, which holds the foil on the upper side of the stack of goods, while the sides of the foil wrapping are removed. The holding-down means could be provided with heating wires, particularly arranged in a stellar pattern, for producing the desired tearing lines in the upper side of the foil.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
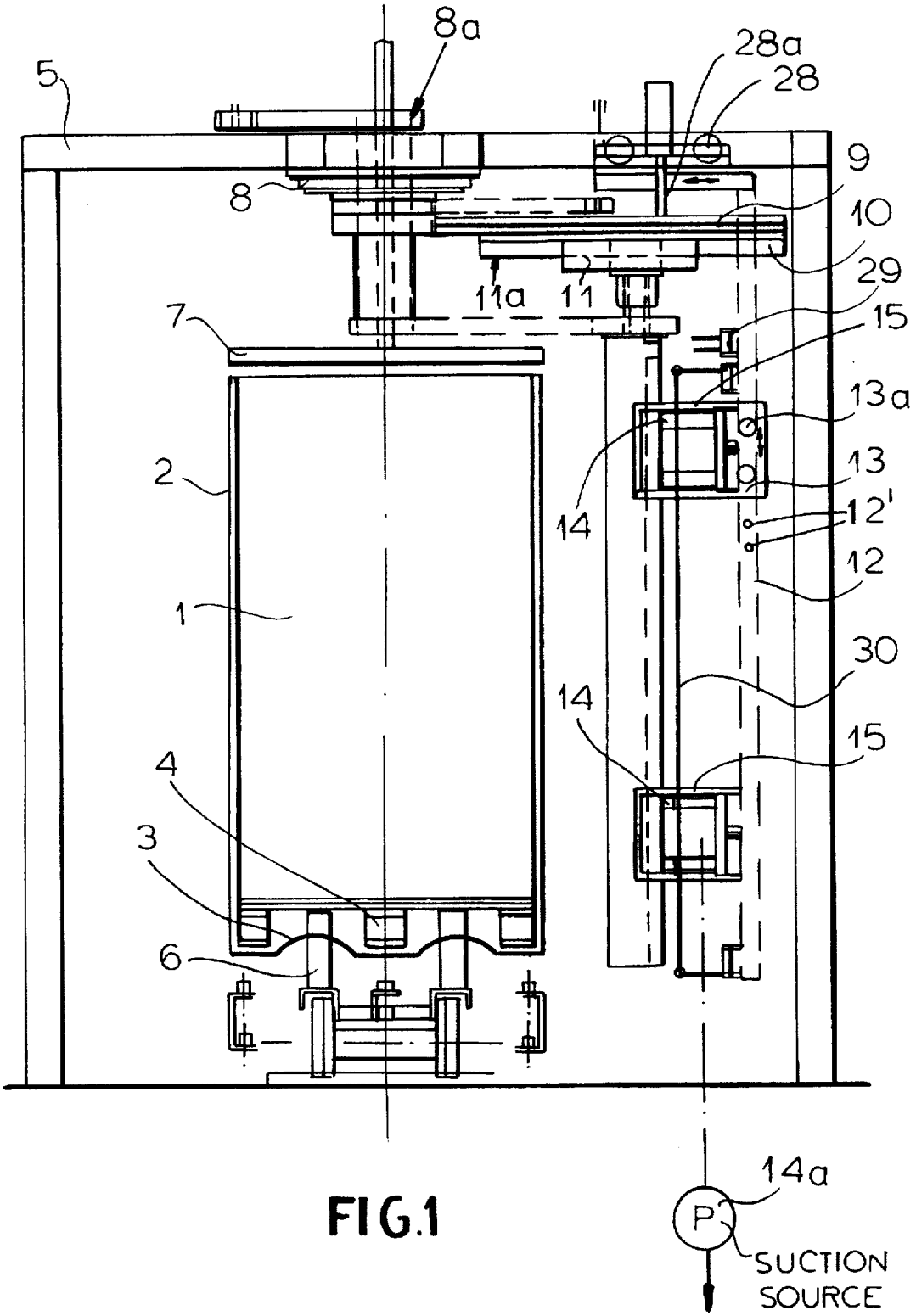
FIG. 1 is a schematic side view of a device for the removal of a foil wrapping drawn over a stack of goods.
Figure 2:
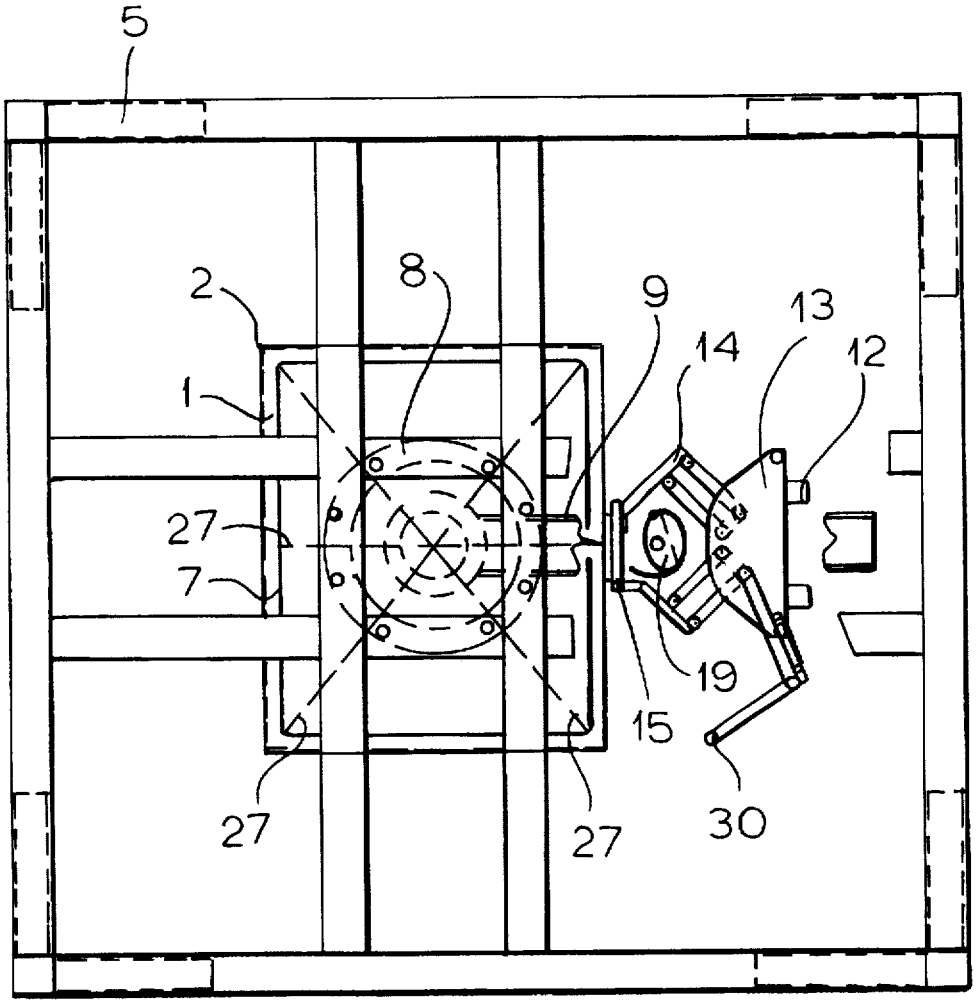
FIG. 2 is a schematic top view of the device of FIG. 1.
Figure 3:
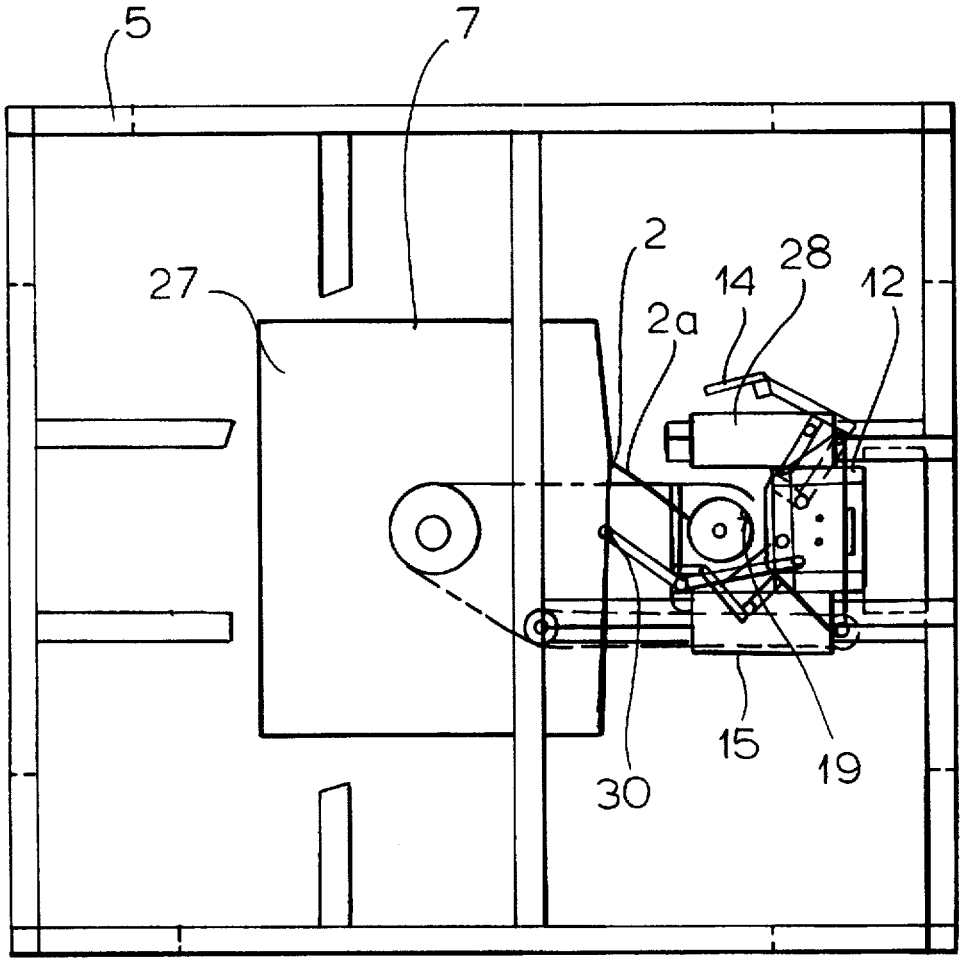
FIG. 3 is a view similar to FIG. 2 showing the mechanism in a different functional position.

By means of the illustrated device the shrink foil wrapping 2 can be removed from a palletted stack of goods 1 protected by the shrink foil wrapping, which also reaches the underside of the pallet 4 with a bottom shrinkage 3. For this purpose the stack of goods 1 is transported under a frame 5 and positioned on a lifting mechanism 6 (FIG. 1). A holding-down means 7 provided at its underside with heating wires 27 (FIG. 2) arranged in a stellar pattern is lowered onto the upper side of the stack of goods.

A turntable 8, rotatable about a vertical axis, is supported on the upper side of frame 5 and is rotatable by a drive 8*a*. From the turntable 8 a supporting arm 9 extends horizontally and has on its underside a guide 10 for a guide slide carriage 11. The guide slide carriage 11 can be moved back and forth in the longitudinal direction of the supporting arm 9 by a drive 11*a*.

On the basic frame 5 a horizontal slide 28 with a vertical guide mast 12 is suspended, in whose upper area a lifting slide carriage 13 can be moved up and down by means of a drive 13a, in order to adjust to the pallet height. On its side facing the stack of goods 1 the lifting slide carriage 13 carries a suction device 14 connected to a suction source 14a and which can be swung by lifting cylinders, and also a U-shaped separating device 15 swingable by lifting cylinders. The same suction device 14 and the separating device 15 are fastened to the lower part of the guide mast 12. The mast is provided with hot air nozzles 12' formed along the mast.

Figure 4:
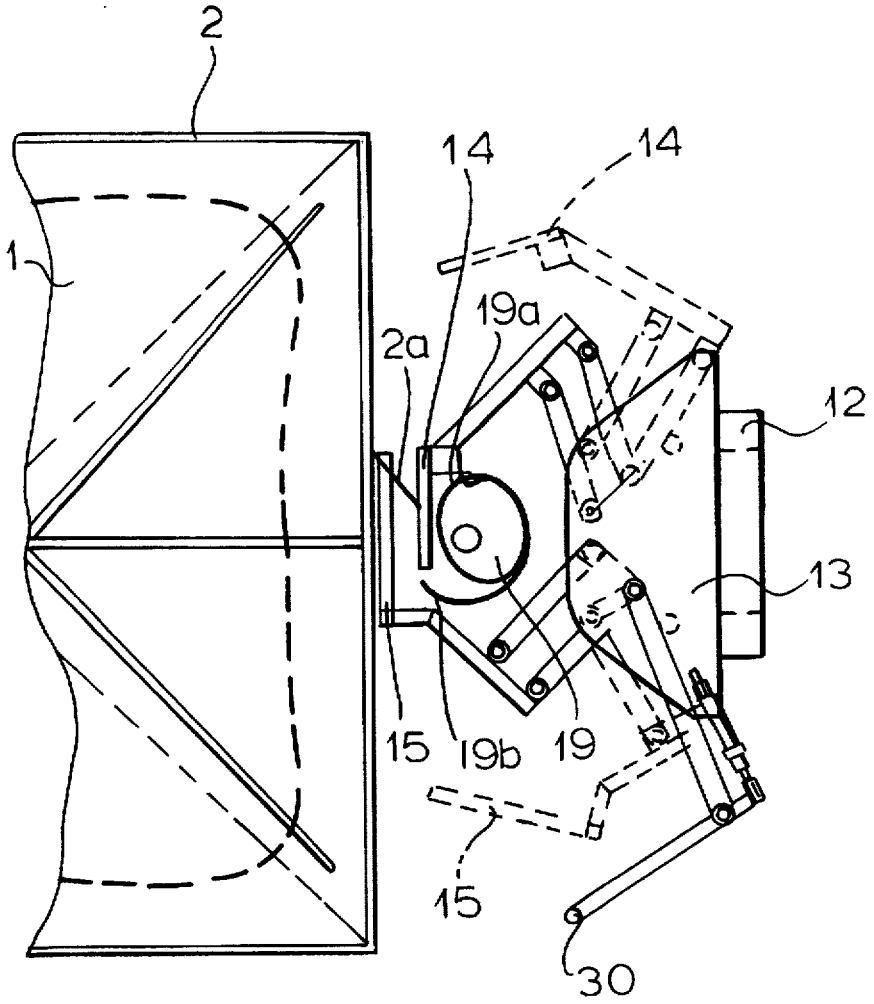
FIG. 4 is a schematic partial top view of the stack of goods and the gripping device, drawn to an enlarged scale.
Figure 5:
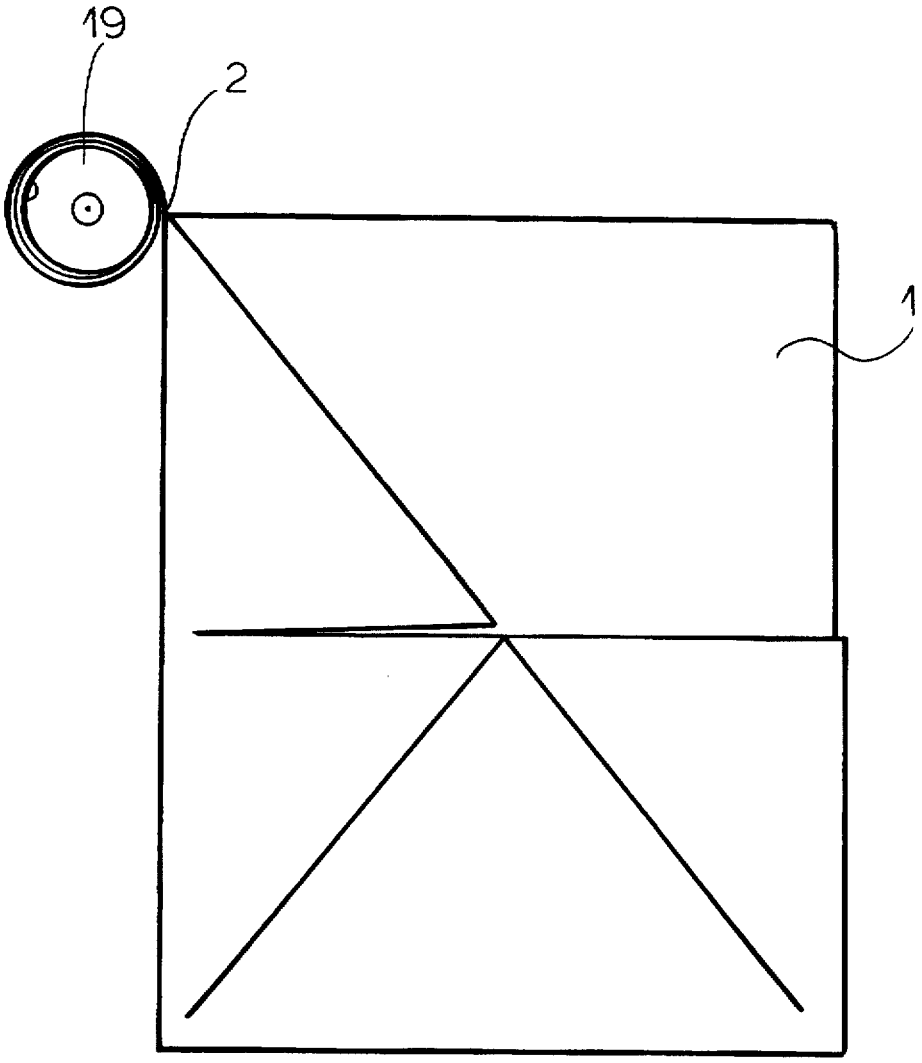
FIG. 5 is a view of a portion of the mechanism of FIG. 4 in a different functional position.
Figure 6:
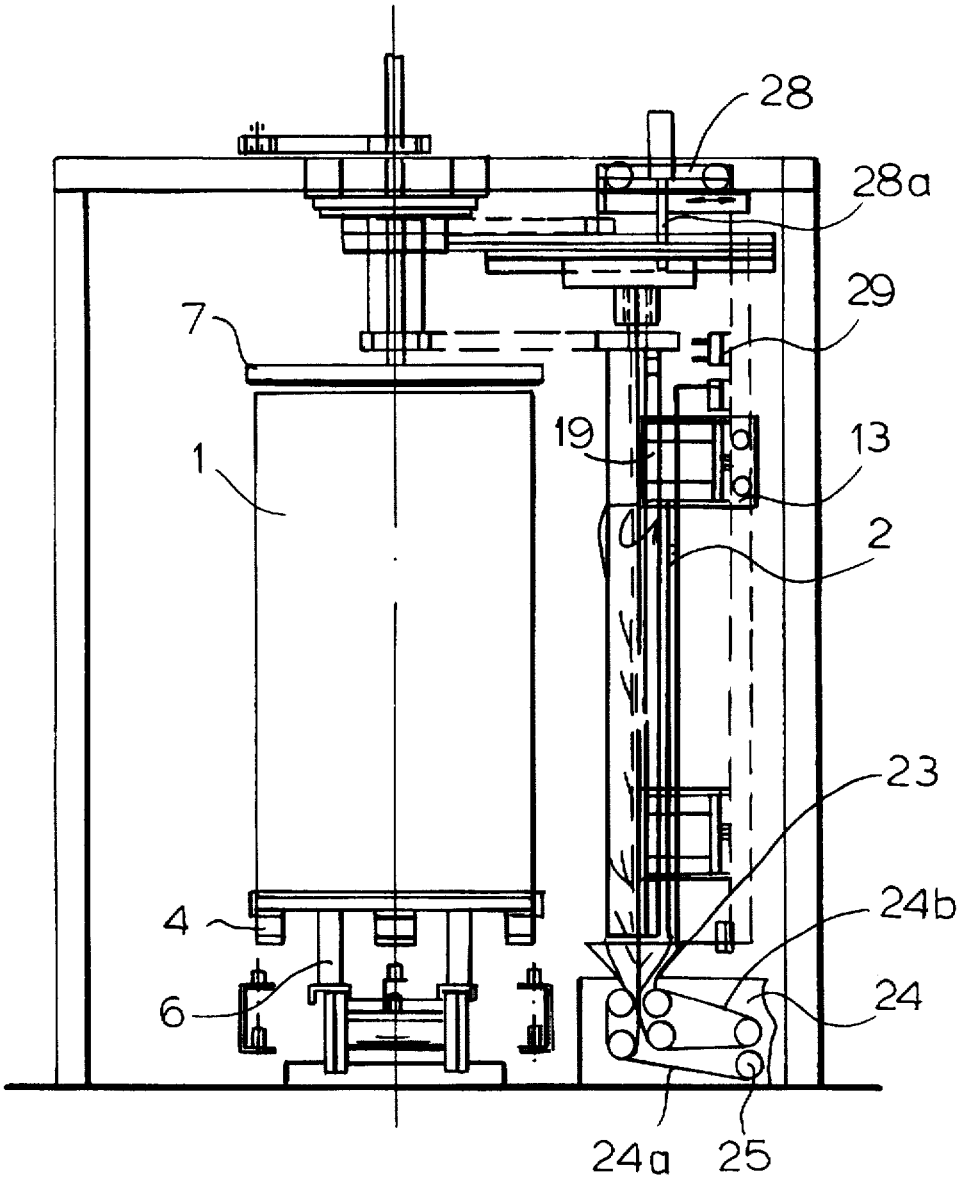
FIG. 6 is a view similar to FIG. 1, but with the foil unwrapped from the stack of goods and with foil compactor.

The horizontal slide 28 engages via a spindle 28a driven by a lifting cylinder in the guide slide carriage 11 of the winding spindle 19. After that the horizontal slide 28 with the winding spindle 19, the suction device 14 and the separating device 15 are moved against the stack of goods 1, whereby the suction device 14 affixes itself by suction to the shrink foil wrapping 2. Then the suction device 14 is moved towards the winding spindle 19 by means of a lifting cylinder, and thereby the aspired shrink foil wrapping 2 is pulled towards the U-shaped heating wire of the separating device 15, whereby a U-shaped foil tab 2a is separated from the shrink foil wrapping 2. After that the winding spindle 19 with its fixed cheek 19b rotates past the suction device 14 and is closed by a lever system 29 fastened to the horizontal slide 28, which with the assistance of lifting cylinders closes the loose cheek 19a against the fixed cheek 19b (FIG. 4), whereby the foil tabs 2a are fastened in the winding spindle 19 by clamping. The winding spindle 19 is moved a little further from the pallet by the guide slide carriage 11, whereby the shrink foil wrapping 2 pulls itself away from the load between the two foil tabs 2a. A vertical heating wire 30 having an antiadhesion coating 30' thereon can be swung against a pulled off foil area to separate a pulled off portion. After the free cutoff edge of both foil tabs 2a is fastened in the winding spindle 19, the winding spindle 19 with the supporting arm 9 travels around the stack of goods 1. Thereby the foil is wrapped around the winding spindle 19 rotating about its vertical axis. This applies also to the foil of the bottom shrinkage 3.

The foil on the upper side of the stack of goods 1 is separated into segments by the heating wires 27 of the holding-down means 7, which during the winding of the foil are pulled out under the holding-down means 7.

The separating device 15 consists basically of a U-shaped frame built around the suction device 14 with blades or separating heating wires not shown in the drawing. It separates the foil 2 which is pulled by the suction device 14 against the separating device 15. The separating device 15 produces a U-shaped tearing line around the suction device 14.

The suction device 14 is removed from the stack of goods 1 and moved into the recess of the winding spindle 19. Thereby it entrains the free edge of foil tabs 2a, which have resulted from the U-shaped cut or the U-shaped fusion lines. Then the winding spindle 19 picks up the foil tabs 2a, which have become accessible to be clamped by the winding spindle due to a free space between the suction devices 14.

The winding spindle 19 can change its circumference by retracting its cheek 19a, which extends over the entire length of the winding spindle 19.

Thus it becomes possible for the foil tabs 2a to be clamped between the cheeks 19a and 19b after the swing out of the cheek 19a of the winding spindle 19.

This construction also makes possible a simple disposal of the foil 2 from the winding spindle 19, by swinging in the cheek 19a, thereby cancelling the clamping effect and also reducing the circumference of the winding spindle 19, so that the wound up foil 2 can slide off the winding spindle 19 by itself. Thereby it can be arranged for the wound up foil to fall directly into a funnel 23 and to be compacted in a subsequently arranged roller

We claim:

1. A method of removing a foil wrapping from a stock of goods comprising the steps of:

a) vertically cutting open the foil wrapping drawn over the stack of goods on one side of the stack of goods;

b) seizing a portion of the foil wrapping which is vertically cut open and fastening said portion to a winding spindle having a vertical longitudinal axis;

c) winding the foil wrapping onto the winding spindle by rotating the winding spindle about said longitudinal axis;

d) simultaneously guiding said winding spindle around the stack of goods as the foil is wound on said spindle, thereby removing the foil wrapping from said stack of goods.

2. The method according to claim 1 wherein the foil wrapping is lifted off the stack of goods area by area and cut open.

3. The method according to claim 1 wherein the winding spindle is guided around the stack of goods at a distance therefrom which remains constant.

4. The method according to claim 1 wherein the winding spindle rotating about its longitudinal axis pulls itself on the foil around the stack of goods.

5. The method according to claim 1 wherein the foil wrapping is at least partially heated, area by area, prior to unwinding.

6. The method according to claim 1 wherein the foil wrapping is heated in the an area underneath the stack of goods.

7. The method according to claim 1 wherein the foil wrapping is heated in an area of a pallet supporting the stack of goods.

8. The method according to claim 1 wherein the stack of goods is lifted for removal of foil shrunk on a bottom of the stack.

9. A device for removing of a foil wrapping drawn over a stack of goods, comprising:

a frame;

a supporting arm supported on said frame so that said arm can rotate about a vertical axis and can be driven about the axis;

a winding spindle suspended from said arm and having a vertical spindle axis;

a guide slide carriage slidable on said arm, the winding spindle and a guide mast parallel to said spindle being suspended from said arm, and a separating element on said mast shiftable toward said foil wrapping for separating a tab of said foil wrapping for enabling said foil wrapping to be wound up on said spindle as said spindle is rotated and displaced around said stack.

10. The device according to claim 9, wherein the separating element has a suction member which can be connected to a suction source.

11. The device according to claim 9 wherein the separating element includes a blade.

12. The device according to claim 9 wherein the separating element includes a heating wire extending parallel to the winding spindle.

13. The device according to claim 9 wherein the guide mast adjustable hot air nozzles are arranged in its longitudinal direction.

14. The device according to claim 9 wherein at a lower end of the guide mast a suction member is connected to said separating element.

15. The device according to claim 9 wherein the frame is equipped with hold-down means which is provided with at least one heating wire extending from a center, for producing tearing lines in an upper side of the foil wrapping.

16. The device according to claim 9 wherein a heating wire is provided for cutting said foil wrapping and has an antiadhesion coating.

17. The device according to claim 9 wherein the winding spindle has two shell-shaped cheeks one of said cheeks being swingable with respect to the other of said cheeks so that, when a cross section of the winding spindle is a maximum, a foil tab can be clamped between the cheeks and, when the cross section of the winding spindle is minimal, a winding of the foil wrapping can be removed.

* * * * *